US010872574B2

(12) United States Patent
Sohn et al.

(10) Patent No.: US 10,872,574 B2
(45) Date of Patent: Dec. 22, 2020

(54) DISPLAY DEVICE INCLUDING A PLURALITY OF CONTROLLERS PERFORMING LOCAL DIMMING

(71) Applicant: Samsung Display Co., Ltd., Yongin-si (KR)

(72) Inventors: Youngsoo Sohn, Yongin-si (KR); Yoongu Kim, Seoul (KR); Seung Young Choi, Yongin-si (KR); Akihiro Takegama, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/439,637

(22) Filed: Jun. 12, 2019

(65) Prior Publication Data

US 2020/0090598 A1 Mar. 19, 2020

(30) Foreign Application Priority Data

Sep. 17, 2018 (KR) ..... 10-2018-0111142

(51) Int. Cl.
*G09G 3/34* (2006.01)
*G09G 3/36* (2006.01)

(52) U.S. Cl.
CPC ..... *G09G 3/3426* (2013.01); *G09G 3/3607* (2013.01); *G09G 3/3685* (2013.01); *G09G 2320/0233* (2013.01); *G09G 2320/0686* (2013.01)

(58) Field of Classification Search
CPC ..... G09G 3/3426; G09G 2320/0233; G09G 2320/0646; G09G 2300/026; G09G 3/3685
See application file for complete search history.

(56) References Cited

U.S. PATENT DOCUMENTS

2014/0240201 A1* 8/2014 Takahashi ..... G06F 3/1446 345/1.3
2017/0010845 A1* 1/2017 Noguchi ..... G06F 3/1446
2018/0047345 A1* 2/2018 Dunn ..... G09G 3/342
2019/0189063 A1* 6/2019 Kitani ..... G09G 3/2025

FOREIGN PATENT DOCUMENTS

KR 10-1611913 B1 4/2016

* cited by examiner

*Primary Examiner* — Xuemei Zheng
(74) *Attorney, Agent, or Firm* — Lewis Roca Rothgerber Christie LLP

(57) ABSTRACT

A display device includes a backlight unit including a plurality of light emitting blocks, a first controller configured to generate first block representative value information for first pixel blocks based on first image data, and a second controller configured to generate second block representative value information for second pixel blocks based on second image data. The first controller receives the second block representative value information from the second controller, and the second controller receives the first block representative value information from the first controller. The first and second controllers generate duty information for the plurality of light emitting blocks based on the first and second block representative value information, and generate light profile information of the backlight unit. The first controller compensates the first image data based on the light profile information, and the second controller compensates the second image data based on the light profile information.

19 Claims, 14 Drawing Sheets

FIG. 2

110a

| | | | | | | |
|---|---|---|---|---|---|---|
| BL(1,1) | BL(1,2) | ... | BL(1,M/2) | BL(1,M/2+1) | BL(1,M/2+2) | ... | BL(1,M) |
| BL(2,1) | BL(2,2) | ... | BL(2,M/2) | BL(2,M/2+1) | BL(2,M/2+2) | ... | BL(2,M) |
| ... | ... | ... | ... | ... | ... | ... | ... |
| BL(N,1) | BL(N,2) | ... | BL(N,M/2) | BL(N,M/2+1) | BL(N,M/2+2) | ... | BL(N,M) |

DISPLAY DEVICE INCLUDING A PLURALITY OF CONTROLLERS PERFORMING LOCAL DIMMING

CROSS-REFERENCE TO RELATED APPLICATION(S)

The present application claims priority to and the benefit of Korean Patent Application No. 10-2018-0111142, filed on Sep. 17, 2018 in the Korean Intellectual Property Office (KIPO), the content of which is incorporated herein in its entirety by reference.

BACKGROUND

1. Field

Aspects of some example embodiments of the present inventive concept relate to display devices.

2. Description of the Related Art

In a display device, such as a liquid crystal display (LCD) device, luminance of each pixel is determined by a product of luminance of a backlight unit and light transmittance of liquid crystals depending on image data. The LCD device may employ a backlight dimming method for the purpose of increasing a contrast ratio and reducing power consumption. The backlight dimming method is a technique that controls backlight luminance and compensates image data by analyzing an input image and adjusting a dimming value based on the analysis. For example, the backlight dimming method intended for reducing power consumption may reduce the backlight luminance by decreasing a dimming value (or a duty), and may increase the luminance through data compensation. Thus, power consumption of the backlight unit may be reduced.

A light emitting diode (LED) backlight unit using LEDs as a light source has been recently used for the backlight unit. The LEDs may boast of high luminance and low power consumption, compared with conventional lamps. Because LED backlight units allow for location-based control, they may be driven by local dimming. According to the local dimming technology, the LED backlight unit may be divided into a plurality of light emitting blocks and luminance may be controlled on a bock-by-block basis. In the local dimming method, the backlight unit and the liquid crystal panel may be divided into a plurality of blocks, local dimming values (or duties) may be decided by analyzing image data on a block basis, and the image data may be compensated based on the local dimming values. Accordingly, the contrast ratio may be further increased, and the power consumption may be further decreased.

However, in a case where a display device including a plurality of controllers performs the local dimming method, a boundary between pixel blocks driven by different controllers may be perceived by viewers, which may decrease the quality of the displayed image and the user experience.

The above information disclosed in this Background section is only for enhancement of understanding of the background of the invention and therefore it may contain information that does not constitute prior art that is already known in this country to a person of ordinary skill in the art.

SUMMARY

Aspects of some example embodiments of the present inventive concept relate to display devices and, for example, to display devices including a plurality of controllers performing local dimming.

Some example embodiments may include a display device capable of preventing or reducing instances of a boundary being perceived between pixel blocks driven by different controllers.

According to some example embodiments, a display device includes: a backlight unit including a plurality of light emitting blocks, a display panel including a plurality of pixel blocks respectively corresponding to the plurality of light emitting blocks, a first controller configured to receive first image data for a first portion of the display panel, and to generate first block representative value information for first pixel blocks located at the first portion of the display panel among the plurality of pixel blocks based on the first image data, and a second controller configured to receive second image data for a second portion of the display panel, and to generate second block representative value information for second pixel blocks located at the second portion of the display panel among the plurality of pixel blocks based on the second image data. The first controller receives the second block representative value information from the second controller, and the second controller receives the first block representative value information from the first controller. Each of the first and second controllers generates duty information for the plurality of light emitting blocks based on the first block representative value information and the second block representative value information, and generates light profile information of the backlight unit based on the duty information. The first controller compensates the first image data based on the light profile information, and the second controller compensates the second image data based on the light profile information.

In some example embodiments, the first block representative value information transferred from the first controller to the second controller may include representative gray values of the first pixel blocks, and the second block representative value information transferred from the second controller to the first controller may include representative gray values of the second pixel blocks.

In some example embodiments, the representative gray value of each pixel block may be determined based on a maximum gray value and an average gray value of a plurality of pixels included in the each pixel block.

In some example embodiments, the first block representative value information transferred from the first controller to the second controller may include a maximum gray value and an average gray value of each of the first pixel blocks, and the second block representative value information transferred from the second controller to the first controller may include a maximum gray value and an average gray value of each of the second pixel blocks.

In some example embodiments, the first block representative value information and the second block representative value information may be simultaneously transferred between the first controller and the second controller.

In some example embodiments, the first block representative value information and the second block representative value information may be transferred between the first controller and the second controller in a vertical blank period.

In some example embodiments, the first block representative value information may be transferred from a light profile output pin of the first controller to a light profile input pin of the second controller, and the second block representative value information may be transferred from a light profile output pin of the second controller to a light profile input pin of the first controller.

In some example embodiments, the first block representative value information and the second block representative value information may be transferred between a data exchange pin of the first controller and a data exchange pin of the second controller.

In some example embodiments, the first controller may include a block representative value memory, a block representative value calculator configured to generate the first block representative value information for the first pixel blocks based on the first image data, and to write the first block representative value information to the block representative value memory, an interface configured to transfer the first block representative value information to the second controller by reading the first block representative value information from the block representative value memory, and to receive the second block representative value information from the second controller to write the second block representative value information to the block representative value memory, a duty calculator configured to generate the duty information for the plurality of light emitting blocks based on the first block representative value information and the second block representative value information, a light profile calculator configured to generate the light profile information of the backlight unit based on the duty information, and a data compensator configured to compensate the first image data based on the light profile information.

In some example embodiments, the block representative value memory may include a first memory unit to which the first block representative value information is written, and a second memory unit to which the second block representative value information is written. The first memory unit and the second memory unit may be independently accessed.

In some example embodiments, the duty calculator may generate the duty information by performing spatial filtering and temporal filtering on representative gray values of the plurality of pixel blocks represented by the first block representative value information and the second block representative value information.

In some example embodiments, the light profile calculator may generate, as the light profile information, a light intensity value by the plurality of light emitting blocks at one or more reference positions with respect to each of the plurality of pixel blocks based on the duty information.

In some example embodiments, the data compensator may calculate, with respect to each pixel located at the first portion of the display panel, a light intensity value of the each pixel by performing a bilinear interpolation on the light intensity values at the reference positions adjacent to the each pixel, and adjusts the first image data for the each pixel based on the light intensity value of the each pixel.

In some example embodiments, the second controller may include a block representative value memory, a block representative value calculator configured to generate the second block representative value information for the second pixel blocks based on the second image data, and to write the second block representative value information to the block representative value memory, an interface configured to transfer the second block representative value information to the first controller by reading the second block representative value information from the block representative value memory, and to receive the first block representative value information from the first controller to write the first block representative value information to the block representative value memory, a duty calculator configured to generate the duty information for the plurality of light emitting blocks based on the first block representative value information and the second block representative value information, a light profile calculator configured to generate the light profile information of the backlight unit based on the duty information, and a data compensator configured to compensate the second image data based on the light profile information.

In some example embodiments, the display device may further include a first data driver configured to receive the compensated first image data from the first controller, and to provide data voltages to the first portion of the display panel based on the compensated first image data, and a second data driver configured to receive the compensated second image data from the second controller, and to provide data voltages to the second portion of the display panel based on the compensated second image data.

In some example embodiments, the display device may further include a first backlight driver configured to receive the duty information for first light emitting blocks corresponding to the first pixel blocks among the plurality of light emitting blocks from the first controller, and to drive the first light emitting blocks with duty values represented by the duty information for the first light emitting blocks, and a second backlight driver configured to receive the duty information for second light emitting blocks corresponding to the second pixel blocks among the plurality of light emitting blocks from the second controller, and to drive the second light emitting blocks with duty values represented by the duty information for the second light emitting blocks.

In some example embodiments, the display device may further include a third controller configured to receive third image data for a third portion of the display panel, and to generate third block representative value information for third pixel blocks located at the third portion of the display panel among the plurality of pixel blocks based on the third image data, and a fourth controller configured to receive fourth image data for a fourth portion of the display panel, and to generate fourth block representative value information for fourth pixel blocks located at the fourth portion of the display panel among the plurality of pixel blocks based on the fourth image data. The first through fourth controllers may be connected in a ring structure with respect to the first through fourth block representative value information.

In some example embodiments, a light profile output pin of the first controller may be connected to a light profile input pin of the second controller, a light profile output pin of the second controller may be connected to a light profile input pin of the third controller, a light profile output pin of the third controller may be connected to a light profile input pin of the fourth controller, and a light profile output pin of the fourth controller may be connected to a light profile input pin of the first controller.

In some example embodiments, during a first portion of a vertical blank period, the first block representative value information may be transferred from the first controller to the second controller, the second block representative value information may be transferred from the second controller to the third controller, the third block representative value information may be transferred from the third controller to the fourth controller, and the fourth block representative value information may be transferred from the fourth controller to the first controller. During a second portion of a vertical blank period, the fourth block representative value information may be transferred from the first controller to the second controller, the first block representative value information may be transferred from the second controller to the third controller, the second block representative value information may be transferred from the third controller to the fourth controller, and the third block representative value information may be transferred from the fourth controller to the first controller. During a third portion of a vertical blank period, the third block representative value information may be transferred from the first controller to the second controller, the fourth block representative value information may be transferred from the second controller to the third controller, the first block representative value information may be transferred from the third controller to the fourth controller, and the second block representative value information may be transferred from the fourth controller to the first controller.

According to some example embodiments, a display device includes: a backlight unit including a plurality of light emitting blocks, a display panel including a plurality of pixel blocks respectively corresponding to the plurality of light emitting blocks, and a plurality of controllers, each of the plurality of controllers configured to receive image data for a corresponding portion of the display panel, and to generate block representative value information for a portion of the plurality of pixel blocks located at the corresponding portion of the display panel based on the image data. Each of the plurality of controllers may include a light profile output pin at which the block representative value information is output, and a light profile input pin at which the block representative value information is received from another controller among the plurality of controllers. The plurality of controllers may be connected in a ring structure such that the light profile output pin of the each of the plurality of controllers is connected to the light profile input pin of the another controller.

As described above, in the display device according to some example embodiments, block representative value information generated by a plurality of controllers may be transferred among the plurality of controllers. Each of the plurality of controllers may generate light profile information based on the block representative value information for all of a plurality of pixel blocks, and may compensate image data based on the light profile information. Accordingly, because the respective controllers may compensate the image data based on substantially the same light profile information, a boundary between the pixel blocks driven by different controllers may not be perceived by viewers.

BRIEF DESCRIPTION OF THE DRAWINGS

Illustrative, non-limiting example embodiments will be more clearly understood from the following detailed description in conjunction with the accompanying drawings.

FIG. 2 is a diagram illustrating an example where a backlight unit included in a display device of FIG. 1 is divided into a plurality of light emitting blocks.

DETAILED DESCRIPTION

Hereinafter, aspects of some example embodiments of the present inventive concept will be explained in more detail with reference to the accompanying drawings.

Figure 1:
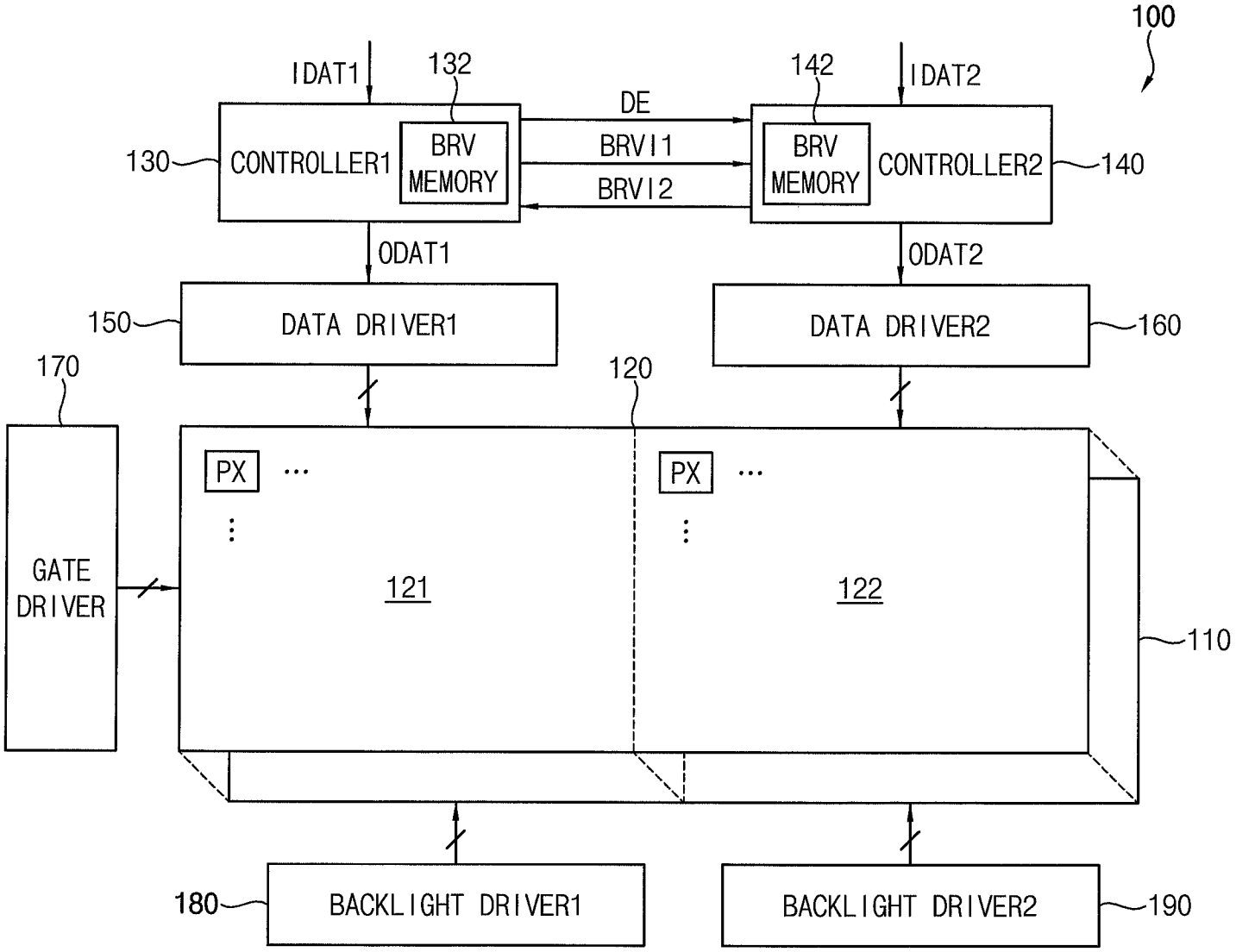
FIG. 1 is a block diagram illustrating a display device according to some example embodiments.
Figure 3:
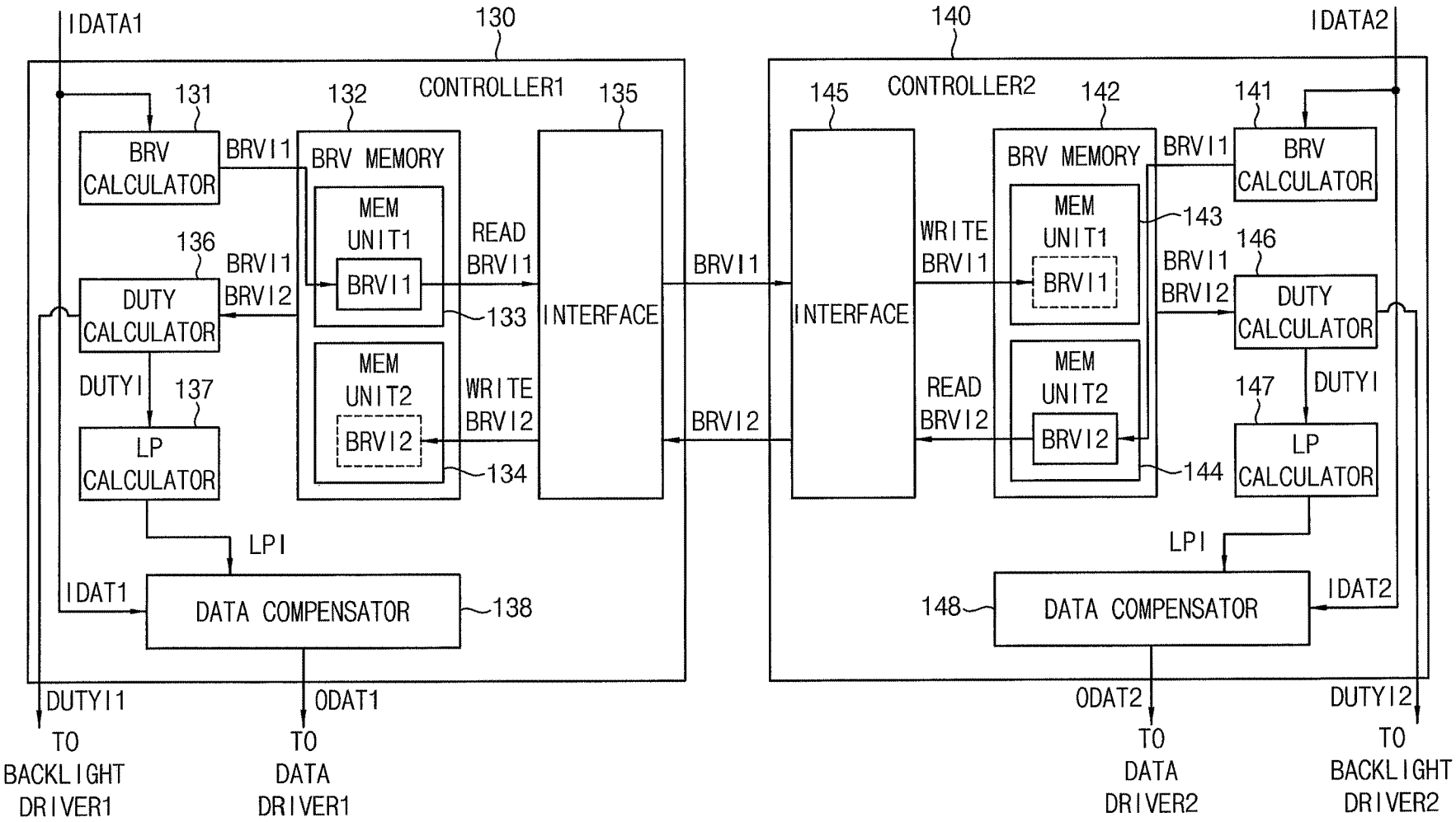
FIG. 3 is a block diagram illustrating an example of first and second controllers included in a display device of FIG. 1.
Figure 4:
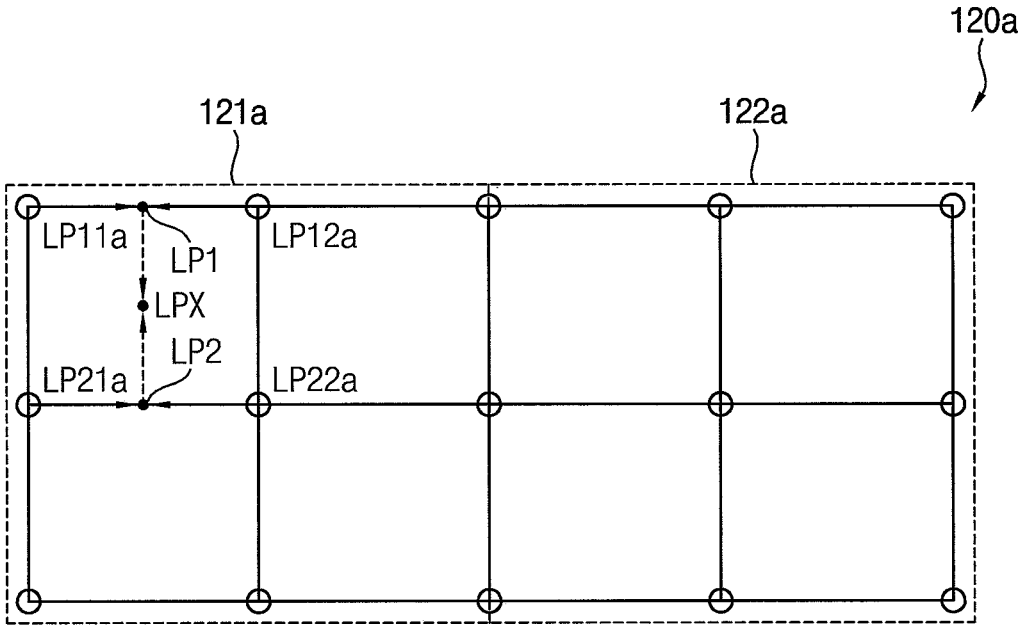
FIG. 4 is a diagram for describing an example of light profile information and an example where image data are compensated based on the light profile information.
Figure 5:
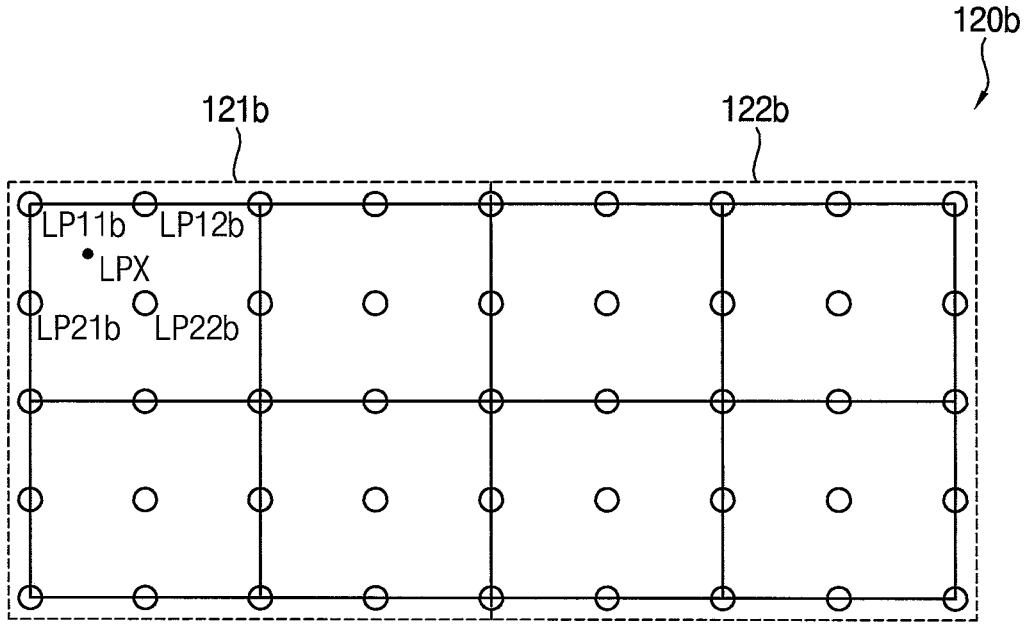
FIG. 5 is a diagram for describing another example of light profile information and another example where image data are compensated based on the light profile information.

FIG. 1 is a block diagram illustrating a display device according to some example embodiments, FIG. 2 is a diagram illustrating an example where a backlight unit included in a display device of FIG. 1 is divided into a plurality of light emitting blocks, FIG. 3 is a block diagram illustrating an example of first and second controllers included in a display device of FIG. 1, FIG. 4 is a diagram for describing an example of light profile information and an example where image data are compensated based on the light profile information, and FIG. 5 is a diagram for describing another example of light profile information and another example where image data are compensated based on the light profile information.

Referring to FIG. 1, a display device 100 may include a backlight unit 110 including a plurality of light emitting blocks, a display panel 120 including a plurality of pixel blocks respectively corresponding to the plurality of light emitting blocks, a first controller 130 that receives first image data IDAT1 for a first portion 121 of the display panel 120, and a second controller 140 that receives second image data IDAT2 for a second portion 122 of the display panel 120. In some example embodiments, the display device 100 may further include a first data driver 150 controlled by the first controller 130 to provide data voltages to the first portion 121 of the display panel 120, a second data driver 160 controlled by the second controller 140 to provide data voltages to the second portion 122 of the display panel 120, a gate driver 170 configured to provide gate signals to the display panel 120, a first backlight driver 180 controlled by the first controller 130, and a second backlight driver 190 controlled by the second controller 140.

The backlight unit 110 may include the plurality of light emitting blocks that are independently operated. Here, the independent operations of the plurality of light emitting blocks refers to the plurality of light emitting blocks emitting light with different luminance or different light intensities. For example, as illustrated in FIG. 2, the backlight unit 110*a* may be divided into M*N light emitting blocks BL(1,1) through BL(N,M) that are independently operated, where each of M and N is an integer greater than 1. That is, in an example of FIG. 2, the backlight unit 110*a* may include M/2*N light emitting blocks BL(1,1), BL(1,2), . . . , BL(1, M/2), BL(2,1), BL(2,2), . . . , BL(2,M/2), . . . , BL(N,1), BL(N,2), . . . , BL(N,M/2) corresponding to the first portion 121 of the display panel 120, and M/2*N light emitting blocks BL(1,M/2+1), BL(1,M/2+2), . . . , BL(1,M), BL(2,M/2+1), BL(2,M/2+2), . . . , BL(2,M), . . . , BL(N,M/2+1), BL(N,M/2+2), . . . , BL(N,M) corresponding to the second portion 122 of the display panel 120. In some example embodiments, the backlight unit 110 may be a direct-type light emitting diode (LED) backlight using LEDs as a light source, but not be limited to the direct-type LED backlight.

The display panel 120 may include a plurality of data lines, a plurality of gate lines, and a plurality of pixels PX coupled to the plurality of data lines and the plurality of gate lines. In some example embodiments, each pixel PX may include a switching transistor and a liquid crystal capacitor coupled to the switching transistor, and the display panel 410 may be a liquid crystal display (LCD) panel. However, the display panel 120 may not be limited to being LCD panel, and the display panel 120 may be any suitable display panel. In the display device 100 of FIG. 1, the pixels PX located at the first portion 121 of the display panel 120 may be driven by the first data driver 150 controlled by the first controller 130, and the pixels PX located at the second portion 122 of the display panel 120 may be driven by the second data driver 160 controlled by the second controller 140.

The display panel 120 may include the plurality of pixel blocks respectively corresponding to the plurality of light emitting blocks of the backlight unit 110. Here, a set of the pixels PX located corresponding to one light emitting block may be referred to as the pixel block. Thus, here, the pixel block may be a logical unit of the pixels that are grouped according to the light emitting block, and the plurality of pixel blocks may not be physically or structurally distinguished from each other. In an example of FIG. 1, the display panel 120 may include, as the plurality of pixel blocks, first pixel blocks located at the first portion 121 of the display panel 120 and second pixel blocks located at the second portion 122 of the display panel 120.

The first data driver 150 may provide the data voltages to the pixels PX located at the first portion 121 of the display panel 120 based on first image data ODAT1 and a first data control signal provided from the first controller 130, and the second data driver 160 may provide the data voltages to the pixels PX located at the second portion 122 of the display panel 120 based on second image data ODAT2 and a second data control signal provided from the second controller 140. For example, each of the first and second data control signals may include, but not be limited to, a horizontal start signal and a load signal. In some example embodiments, each of the first and second data drivers 150 and 160 may be implemented with one or more data integrated circuits (ICs). Further, according to some example embodiments, the first and second data drivers 150 and 160 may be mounted directly on the display panel 120, or may be coupled to the display panel 120 in a form of a tape carrier package (TCP). In other example embodiments, the first and second data drivers 150 and 160 may be integrated in a peripheral portion of the display panel 120.

The gate driver 170 may provide the gate signals to the pixels PX of the display panel 120 based on a gate control signal provided from the first controller 130 that is set as a master controller. For example, the gate control signal may include, but not be limited to, a frame start signal and a gate clock signal. In some example embodiments, the gate driver 170 may be implemented with one or more gate ICs. Further, according to some example embodiments, the gate driver 170 may be mounted directly on the display panel 120, or may be coupled to the display panel 120 in the form of the TCP. In other example embodiments, the gate driver 170 may be implemented as an amorphous silicon gate (ASG) driver integrated in the peripheral portion of the display panel 120.

The first controller 130 may receive the first image data IDAT1 for the first portion 121 of the display panel 120 and a control signal from an external host processor (e.g., a graphic processing unit (GPU) or a graphic card), and the second controller 140 may receive the second image data IDAT2 for the second portion 122 of the display panel 120 and the control signal from the external host processor. For example, the control signal provided from the external host processor may include, but not be limited to, a data enable signal DE, a master clock signal, a vertical synchronization signal, etc. In some example embodiments, each of the first and second controllers 130 and 140 may be a timing controller (TCON). FIG. 1 illustrates an example where the first controller 130 may operate as a master controller, the second controller 140 may operate as a slave controller, and the first controller 130 may provide the data enable signal DE to the second controller 140 such that the first and second controllers 130 and 140 operate in synchronization with each other. However, the first and second controllers 130 and 140 may have substantially the same configuration, and, according to setting, any one of the first and second controllers 130 and 140 may operate as the master controller while the other of the first and second controllers 130 and 140 may operate as the slave controller.

The first controller 130 may generate first block representative value information BRVI1 for the first pixel blocks located at the first portion 121 of the display panel 120 among the plurality of pixel blocks based on the first image data IDAT1, and the second controller 140 may generate second block representative value information BRVI2 for the second pixel blocks located at the second portion 122 of the display panel 120 among the plurality of pixel blocks based on the second image data IDAT2. Further, the first controller 130 may receive the second block representative value information BRVI2 from the second controller 140, and the second controller 140 may receive the first block representative value information BRVI1 from the first controller 130.

In some example embodiments, the first block representative value information BRVI1 transferred from the first controller 130 to the second controller 140 may include representative gray values of the first pixel blocks, and the second block representative value information BRVI2 transferred from the second controller 140 to the first controller 130 may include representative gray values of the second pixel blocks.

Further, in some example embodiments, the representative gray value of each pixel block may be determined based on a maximum gray value and an average gray value of a plurality of pixels PX included in the each pixel block. For example, each of the first and second controllers 130 and 140 may determine a median value of the maximum gray value and the average gray value of the plurality of pixels PX included in the each pixel block as the representative gray value of the each pixel block. In other example embodiments, the first block representative value information BRVI1 transferred from the first controller 130 to the second controller 140 may include the maximum gray value and the average gray value of each of the first pixel blocks, and the second block representative value information BRVI2 transferred from the second controller 140 to the first controller 130 may include the maximum gray value and the average gray value of each of the second pixel blocks.

Because the first controller 130 may receive the second block representative value information BRVI2 from the second controller 140, and the second controller 140 may receive the first block representative value information BRVI1 from the first controller 130, each of the first and second controllers 130 and 140 may store all of the first block representative value information BRVI1 for the first pixel blocks located at the first portion 121 of the display panel 120 and the second block representative value information BRVI2 for the second pixel blocks located at the second portion 122 of the display panel 120 in its own block representative value memory 132 and 142. Each of the first and second controllers 130 and 140 may generate duty information for the plurality of light emitting blocks based on all of the first block representative value information BRVI1 and the second block representative value information BRVI2, and may generate light profile information of the backlight unit by the plurality of light emitting blocks based on the duty information. In some example embodiments, the duty information may include a duty value of a pulse width modulation (PWM) signal applied to each light emitting block, and the first and second backlight drivers 180 and 190 may drive the plurality of light emitting blocks with the duty values represented by the duty information. Further, the light profile information may represent information about luminance or intensity of light emitted by the plurality of light emitting blocks driven with the duty values represented by the duty information, and the light profile information for one pixel block may be determined by considering not only luminance or intensity of light emitted by a light emitting block located corresponding to the pixel block, but also influence, on the pixel block, of light emitted by light emitting blocks located adjacent to the pixel block or by all of the plurality of light emitting blocks.

Further, the first controller 130 may compensate the first image data IDAT1 based on the light profile information by all of the plurality of light emitting blocks, and the second controller 140 may compensate the second image data based on the same light profile information. Accordingly, the first and second controllers 130 and 140 may respectively compensate for the first and second image data IDAT1 and IDAT2 based on the same light profile information, thereby preventing or reducing instances of a phenomenon that a boundary between the first and second portions 121 and 122 of the display panel 120 may be perceived by viewers because of a compensation deviation between the first and second controllers 130 and 140.

In some example embodiments, as illustrated in FIG. 3, each of the first and second controllers 130 and 140 may include a block representative value calculator 131 and 141, a block representative value memory 132 and 142, an interface 135 and 145, a duty calculator 136 and 146, a light profile calculator 137 and 147, and a data compensator 138 and 148.

The block representative value calculator 131 of the first controller 130 may generate the first block representative value information BRVI1 for the first pixel blocks based on the first image data IDAT1, and may write the first block representative value information BRVI1 to the block representative value memory 132. Further, the block representative value calculator 141 of the second controller 140 may generate the second block representative value information BRVI2 for the second pixel blocks based on the second image data IDAT2, and may write the second block representative value information BRVI2 to the block representative value memory 142. In some example embodiments, each block representative value calculator 131 and 141 may calculate, as the block representative value information BRVI1 and BRVI2, a median value of a maximum gray value and an average gray value of a plurality of pixels PX included in each pixel block. In other example embodiments, the block representative value information BRVI1 and BRVI2 may include the maximum gray value and the average gray value of the plurality of pixels PX included in each pixel block.

The interface 135 of the first controller 130 may transfer the first block representative value information BRVI1 to the second controller 140 by reading the first block representative value information BRVI1 from the block representative value memory 132, may receive the second block representative value information BRVI2 from the second controller 140, and may write the second block representative value information BRVI2 to the block representative value memory 132. Further, the interface 145 of the second controller 140 may transfer the second block representative value information BRVI2 to the first controller 130 by reading the second block representative value information BRVI2 from the block representative value memory 142, may receive the first block representative value information BRVI1 from the first controller 130, and may write the first block representative value information BRVI1 to the block representative value memory 132.

In some example embodiments, each block representative value memory 132 and 142 may include a first memory unit 133 and 143 to which the first block representative value information BRVI1 is written and a second memory unit 134 and 144 to which the second block representative value information BRVI2 is written, and the first memory unit 133 and 143 and the second memory unit 134 and 144 may be independently accessed (e.g., that are simultaneously accessible). In this case, the interface 135 of the first controller 130 may read the first block representative value information BRVI1 from the first memory unit 133 to transfer the first block representative value information BRVI1 to the second controller 140, and, at the same time, may write the second block representative value information BRVI2 received from the second controller 140 to the second memory unit 134. Further, the interface 145 of the second controller 140 may read the second block representative value information BRVI2 from the second memory unit 144 to transfer the second block representative value information BRVI2 to the first controller 130, and, at the same time, may write the first block representative value information BRVI1 received from the first controller 130 to the first memory unit 143.

The duty calculator 136 of the first controller 130 may generate the duty information DUTYI for the plurality of light emitting blocks (or all the light emitting blocks) based on the first and second block representative value information BRVI1 and BRVI2 stored in the block representative value memory 132, and the duty calculator 146 of the second controller 140 may generate the duty information DUTYI for the plurality of light emitting blocks (or all the light emitting blocks) based on the first and second block representative value information BRVI1 and BRVI2 stored in the block representative value memory 142. Here, the duty information DUTYI may represent duty values of PWM signals applied to respective light emitting blocks. In some example embodiments, each duty calculator 136 and 146 may generate the duty information DUTYI by performing spatial filtering and temporal filtering on representative gray values of the plurality of pixel blocks (or all the pixel blocks)

represented by the first and second block representative value information BRVI1 and BRVI2, but an operation of each duty calculator 136 and 146 may not be limited to the spatial filtering and the temporal filtering. For example, the spatial filtering may adjust a representative gray value of one pixel block based on representative gray values of pixel blocks that are spatially adjacent to the one pixel block, and the temporal filtering may adjust a representative gray value of a pixel block in a current frame based on a representative gray value of the pixel block in a previous frame.

In some example embodiments, the first controller 130 may provide first duty information DUTYI1 for first light emitting blocks corresponding to the first pixel blocks among the duty information for all the light emitting blocks, and the second controller 140 may provide second duty information DUTYI2 for second light emitting blocks corresponding to the second pixel blocks among the duty information for all the light emitting blocks. The first backlight driver 180 may drive the first light emitting blocks with duty values (or diming values) represented by the first duty information DUTYI1, and the second backlight driver 190 may drive the second light emitting blocks with duty values (or dimming values) represented by the second duty information DUTYI2. In other example embodiments, the first controller 130 may provide the first backlight driver 180 and the second backlight driver 190 with the first duty information DUTYI1 and the second duty information DUTYI2, respectively. In still other example embodiments, the display device 100 may include one backlight driver for driving the backlight unit 110, and the first controller 130 may provide the one backlight driver with the duty information for all the light emitting blocks.

Each of the light profile calculator 137 of the first controller 130 and the light profile calculator 147 of the second controller 140 may generate substantially the same light profile information LPI based on substantially the same duty information DUTYI. Here, the light profile information LPI may represent information about luminance or intensity of light emitted by the plurality of light emitting blocks driven with the duty values represented by the duty information DUTYI, and the light profile information LPI for one pixel block may be determined by considering not only luminance or intensity of light emitted by a light emitting block located corresponding to the pixel block, but also influence, on the pixel block, of light emitted by light emitting blocks located adjacent to the pixel block or by all of the plurality of light emitting blocks. Thus, the light profile information LPI may be determined by considering the influence by respective light emitting blocks on other blocks, and may be referred to as a light spread function (LSF) information.

In some example embodiments, each light profile calculator 137 and 147 may generate, as the light profile information LPI, a light intensity value by the plurality of light emitting blocks at one or more reference positions with respect to each of the plurality of pixel blocks based on the duty information DUTYI. For example, as illustrated in FIG. 4, each light profile calculator 137 and 147 may generate, as the light profile information LPI, light intensity values at vertices (e.g., LP11*a*, LP12*a*, LP21*a*, LP22*a*, etc.) of the plurality of pixel blocks of the display panel 120*a* including the first portion 121*a* and the second portion 122*a*.

In a case where the backlight unit 110 includes M*N light emitting blocks, or where the display panel 120*a* is divided into M*N pixel blocks, each light profile calculator 137 and 147 may generate, as the light profile information LPI, light intensity values at (M+1)*(N+1) reference positions (e.g., LP11*a*, LP12*a*, LP21*a*, LP22*a*, etc.). In another example, as illustrated in FIG. 5, each light profile calculator 137 and 147 may generate, as the light profile information LPI, light intensity values at vertices (e.g., LP11*b*, etc.) of the plurality of pixel blocks of the display panel 120*b* including the first portion 121*b* and the second portion 122*b* and at intermediate positions (e.g., LP12*b*, LP21*b*, LP22*b*, etc.). In a case where the backlight unit 110 includes M*N light emitting blocks, or where the display panel 120*b* is divided into M*N pixel blocks, each light profile calculator 137 and 147 may generate, as the light profile information LPI, light intensity values at (2M+1)*(2N+1) reference positions (e.g., LP11*b*, LP12*b*, LP21*b*, LP22*b*, etc.).

The data compensator 138 of the first controller 130 may compensate the first image data IDAT1 based on the light profile information LPI, and the data compensator 148 of the second controller 140 may compensate the second image data IDAT2 based on substantially the same light profile information LPI. For example, with respect to each pixel PX, one of the data compensators 138 and 148 may increase a value of the image data IDAT1 and IDAT2 for the each pixel PX in proportion to a decrement of a light intensity value represented by the light profile information LPI from the maximum light intensity value.

In some example embodiments, the light profile information LPI may include the light intensity values at a plurality of reference positions. With respect to each pixel PX, one of the data compensators 138 and 148 may calculate a light intensity value of the each pixel PX by performing a bilinear interpolation on the light intensity values at the reference positions adjacent to the each pixel PX, and may adjust the image data IDAT1 and IDAT2 for the each pixel PX based on the light intensity value of the each pixel PX.

In an example of FIG. 4, the data compensator 138 of the first controller 130 may calculate a light intensity value at a pixel position LPX by performing the bilinear interpolation on light intensity values at reference positions LP11*a*, LP12*a*, LP21*a* and LP22*a* adjacent to the pixel position LPX. For example, the data compensator 138 may calculate a light intensity value at a first position LP1 by performing a linear interpolation at the light intensity values at the reference positions LP11*a* and LP12*a*, may calculate a light intensity value at a second position LP2 by performing a linear interpolation at the light intensity values at the reference positions LP21*a* and LP22*a*, and may calculate the light intensity value at the pixel position LPX by performing a linear interpolation at the light intensity values at the first and second positions LP1 and LP2. Further, the data compensator 138 may increase the value of the image data IDAT1 for the pixel PX at the pixel position LPX in proportion to a decrement of the light intensity value at the pixel position LPX from the maximum light intensity value. In the example illustrated in FIG. 5, the data compensator 138 of the first controller 130 may calculate a light intensity value at a pixel position LPX by performing the bilinear interpolation on light intensity values at reference positions LP11*b*, LP12*b*, LP21*b* and LP22*b* adjacent to the pixel position LPX, and may increase the value of the image data IDAT1 for the pixel PX at the pixel position LPX in proportion to a decrement of the light intensity value at the pixel position LPX from the maximum light intensity value.

The first data driver 150 may receive the compensated first image data ODAT1 from the first controller 130, and may provide data voltages to the first portion 121 of the display panel 120 based on the compensated first image data ODAT1. Further, the second data driver 160 may receive the compensated second image data ODAT2 from the second controller 140, and may provide data voltages to the second portion 122 of the display panel 120 based on the compensated second image data ODAT2. Because the compensated first image data ODAT1 and the compensated second image data ODAT2 are compensated based on substantially the same light profile information LPI, a boundary between the first portion 121 and the second portion 122 may not be perceived by viewers.

As described above, in the display device 100 according to some example embodiments, the block representative value information BRVI1 and BRVI2 generated by the plurality of controllers 130 and 140 may be transferred between the plurality of controllers BRVI1 and BRVI2. Each of the plurality of controllers 130 and 140 may generate the light profile information LPI based on the block representative value information BRVI1 and BRVI2 for all of the plurality of pixel blocks, and may compensate the image data IDAT1 and IDAT2 based on the light profile information LPI. Accordingly, because the respective controllers 130 and 140 may compensate the image data IDAT1 and IDAT2 based on substantially the same light profile information LPI, a boundary between the pixel blocks driven by different controllers 130 and 140 may not be perceived by viewers.

Figure 6:
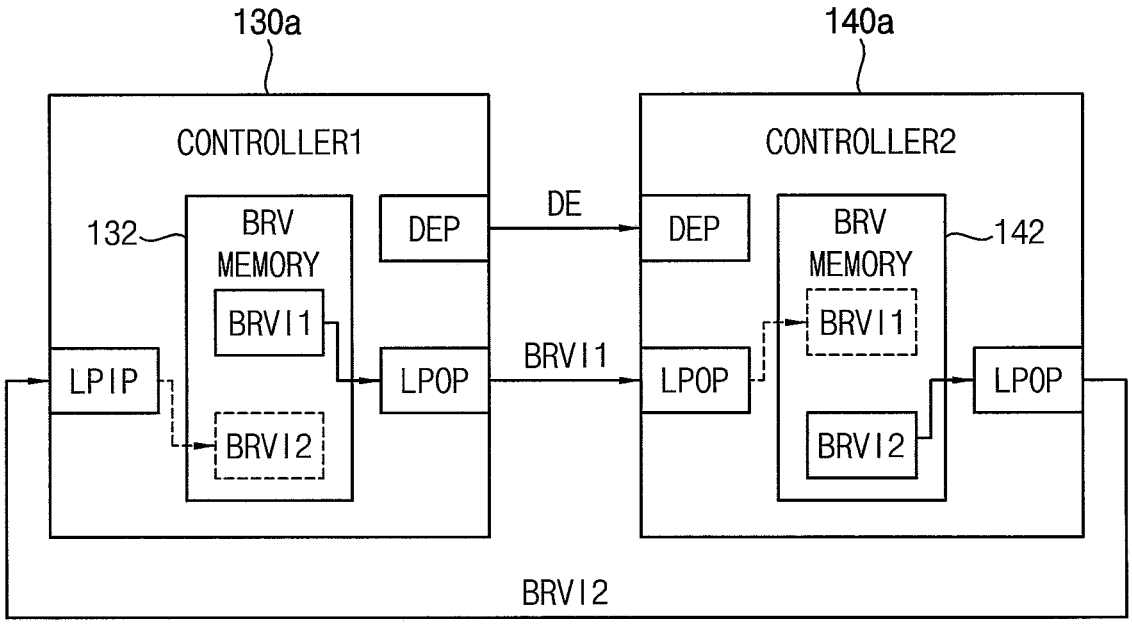
FIG. 6 is a block diagram illustrating an example of first and second controllers included in a display device according to some example embodiments.
Figure 7:
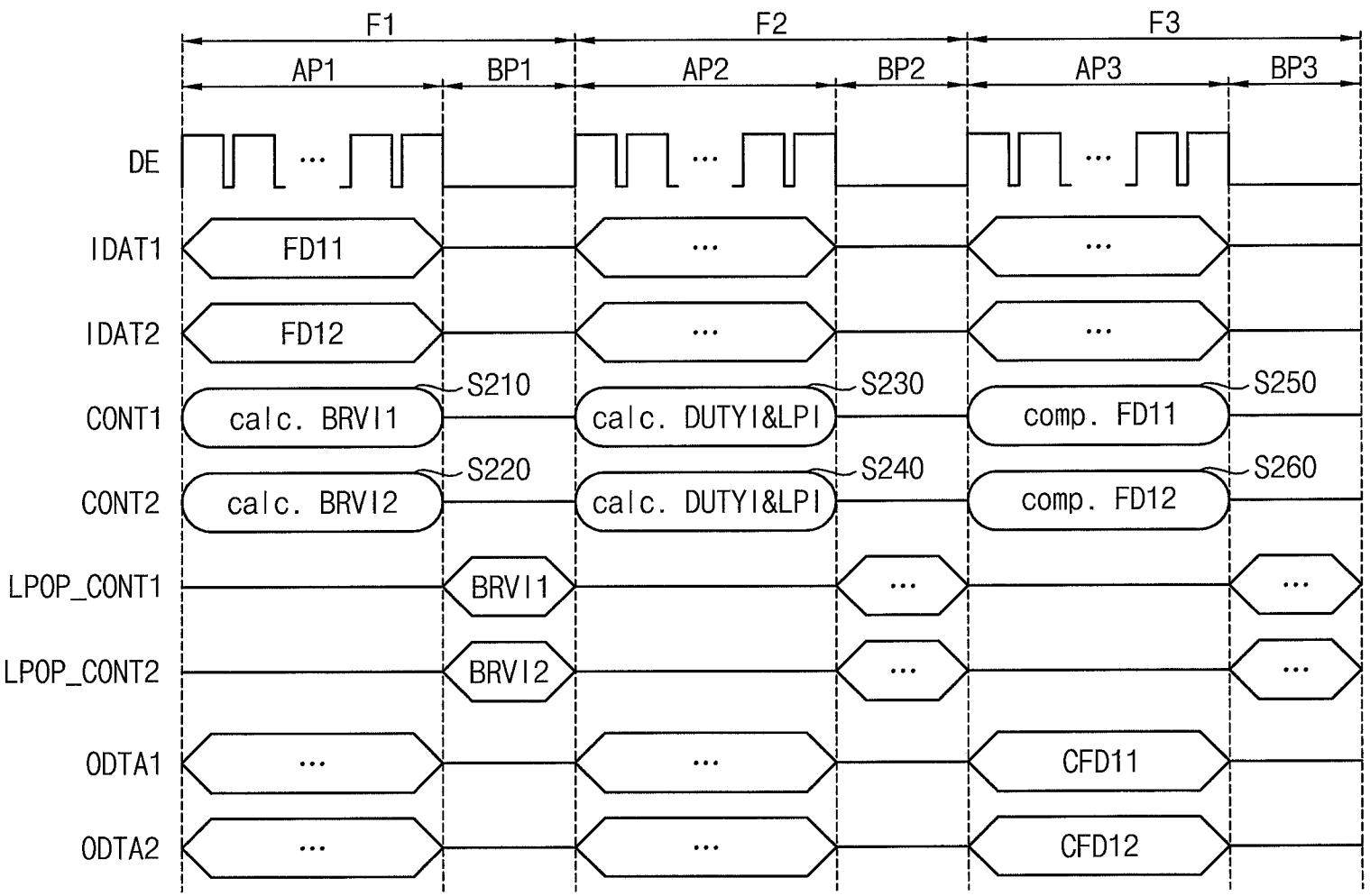
FIG. 7 is a timing diagram for describing operations of first and second controllers illustrated in FIG. 6.

FIG. 6 is a block diagram illustrating an example of first and second controllers included in a display device according to some example embodiments, and FIG. 7 is a timing diagram for describing operations of first and second controllers illustrated in FIG. 6.

Referring to FIG. 6, each of a first controller 130*a* and a second controller 140*a* may include a data enable pin DEP, a light profile output pin LPOP and a light profile input pin LPIP. A data enable signal DE may be transferred from the data enable pin DEP of the first controller 130*a* operating as a master controller to the data enable pin DEP of the second controller 140*a* operating as a slave controller such that the first and second controllers 130*a* and 140*a* operate in synchronization with each other.

First block representative value information BRVI1 generated by the first controller 130*a* may be transferred from the light profile output pin LPOP of the first controller 130*a* to the light profile input pin LPIP of the second controller 140*a*, and second block representative value information BRVI2 generated by the second controller 140*a* may be transferred from the light profile output pin LPOP of the second controller 140*a* to the light profile input pin LP IP of the first controller 130*a*.

In some example embodiments, the first block representative value information BRVI1 and the second block representative value information BRVI2 may be substantially simultaneously transferred between the first controller 130*a* and the second controller 140*a*. Thus, while the first block representative value information BRVI1 is transferred from the light profile output pin LPOP of the first controller 130*a* to the light profile input pin LPIP of the second controller 140*a*, the second block representative value information BRVI2 may be transferred from the light profile output pin LPOP of the second controller 140*a* to the light profile input pin LPIP of the first controller 130*a*. Further, in some example embodiments, the first block representative value information BRVI1 and the second block representative value information BRVI2 may be transferred between the first controller 130*a* and the second controller 140*a* in a vertical blank period between active periods of frames.

For example, referring to FIGS. 1, 6, and 7, in an active period AP1 of a first frame F1, the first controller 130*a* or CONT1 may receive first image data IDAT1 or FD11 for a first portion 121 of a display panel 120, and the second controller 140*a* or CONT2 may receive second image data IDAT2 or FD12 for a second portion 122 of the display panel 120. The first controller 130*a* or CONT1 may calculate the first block representative value information BRVI1 for the first portion 121 of the display panel 120 based on the first image data IDAT1 or FD11 (S210), and the second controller 140*a* or CONT2 may calculate the second block representative value information BRVI2 for the second portion 122 of the display panel 120 based on the second image data IDAT2 or FD12 (S220).

In a vertical blank period BP1 of the first frame F1, the first block representative value information BRVI1 may be transferred from the light profile output pin LPOP of the first controller 130*a* to the light profile input pin LPIP of the second controller 140*a*, and the second block representative value information BRVI2 may be transferred from the light profile output pin LPOP of the second controller 140*a* to the light profile input pin LP IP of the first controller 130*a*.

In an active period AP2 of a second frame F2, each of the first controller 130*a* or CONT1 and the second controller 140*a* or CONT2 may calculate duty information DUTYI and light profile information LPI based on the first and second block representative value information BRVI1 and BRVI2 (S230 and S240). Further, each of the first controller 130*a* or CONT1 and the second controller 140*a* or CONT2 may receive the image data IDAT1 and IDAT2 in the second frame F2. In a vertical blank period BP2 of the second frame F2, the first and second block representative value information BRVI1 and BRVI2 generated based on the image data IDAT1 and IDAT2 in the second frame F2 may be transferred.

In an active period AP3 of a third frame F3, each of the first controller 130*a* or CONT1 and the second controller 140*a* or CONT2 may compensate the image data FD11 and FD12 based on the light profile information LPI generated during the active period AP2 of the second frame F2 (S250 and S260), and may output, as output image data ODAT1 and ODAT2, the compensated image data CFD11 and CFD12. Further, each of the first controller 130*a* or CONT1 and the second controller 140*a* or CONT2 may receive the image data IDAT1 and IDAT2 in the third frame F3. In a vertical blank period BP3 of the third frame F3, the first and second block representative value information BRVI1 and BRVI2 generated based on the image data IDAT1 and IDAT2 in the third frame F3 may be transferred.

As illustrated in FIGS. 6 and 7, the first and second block representative value information BRVI1 and BRVI2 may be transferred via the light profile output pin LPOP and the light profile input pin LPIP of each controller 130*a* and 140*a*. Further, the first and second block representative value information BRVI1 and BRVI2 may be transferred at substantially the same time and/or during the vertical blank period.

Figure 8:
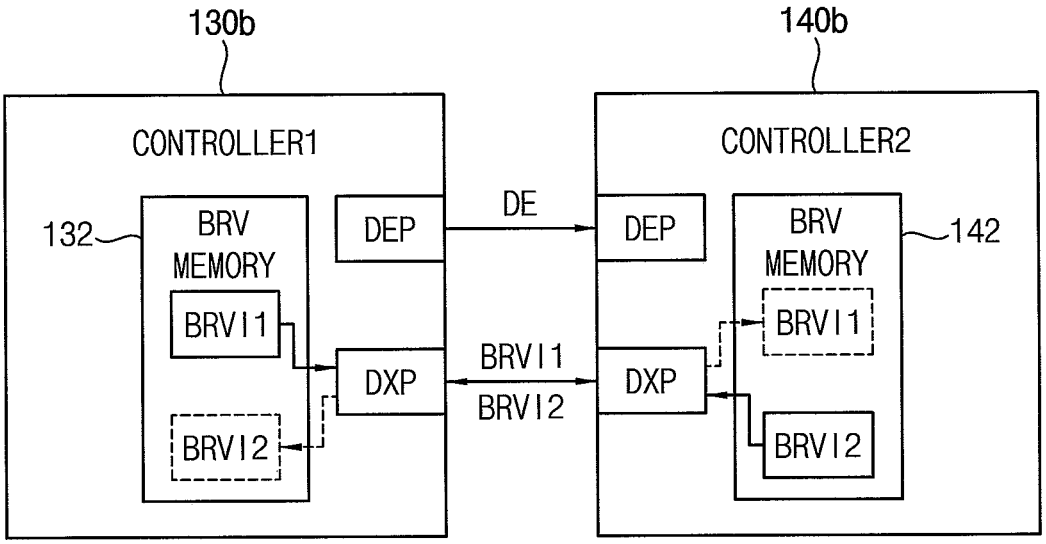
FIG. 8 is a block diagram illustrating an example of first and second controllers included in a display device according to some example embodiments.

FIG. 8 is a block diagram illustrating an example of first and second controllers included in a display device according to some example embodiments.

Referring to FIG. 8, each of a first controller 130*b* and a second controller 140*b* may include a data enable pin DEP and a data exchange pin DXP. In some example embodiments, the data exchange pin DXP may be a bidirectional pin. First block representative value information BRVI1 generated by the first controller 130*b* and second block representative value information BRVI2 generated by the second controller 140*b* may be transferred between the data exchange pin DXP of the first controller 130*b* and the data exchange pin DXP of the second controller 140*b*. In this case, the first and second block representative value information BRVI1 and BRVI2 may not be transferred at the same time, but may be transferred in a time-divisional manner. In some example embodiments, the data exchange pin DXP may be used not only for transferring the first and second block representative value information BRVI1 and BRVI2, but also for image data for pixels adjacent to a boundary between first and second portions of a display panel.

Figure 9:
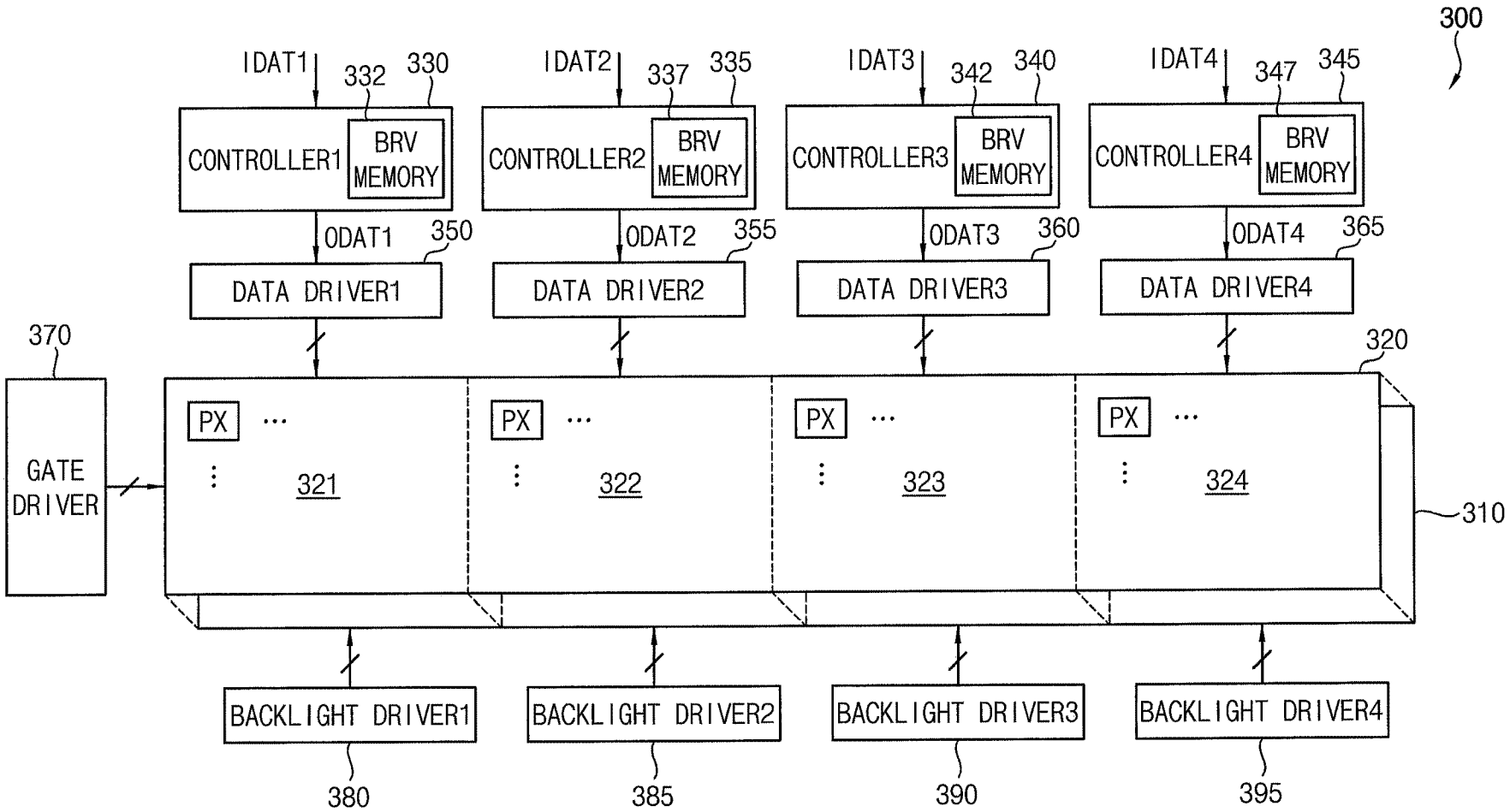
FIG. 9 is a block diagram illustrating a display device according to some example embodiments.
Figure 10:
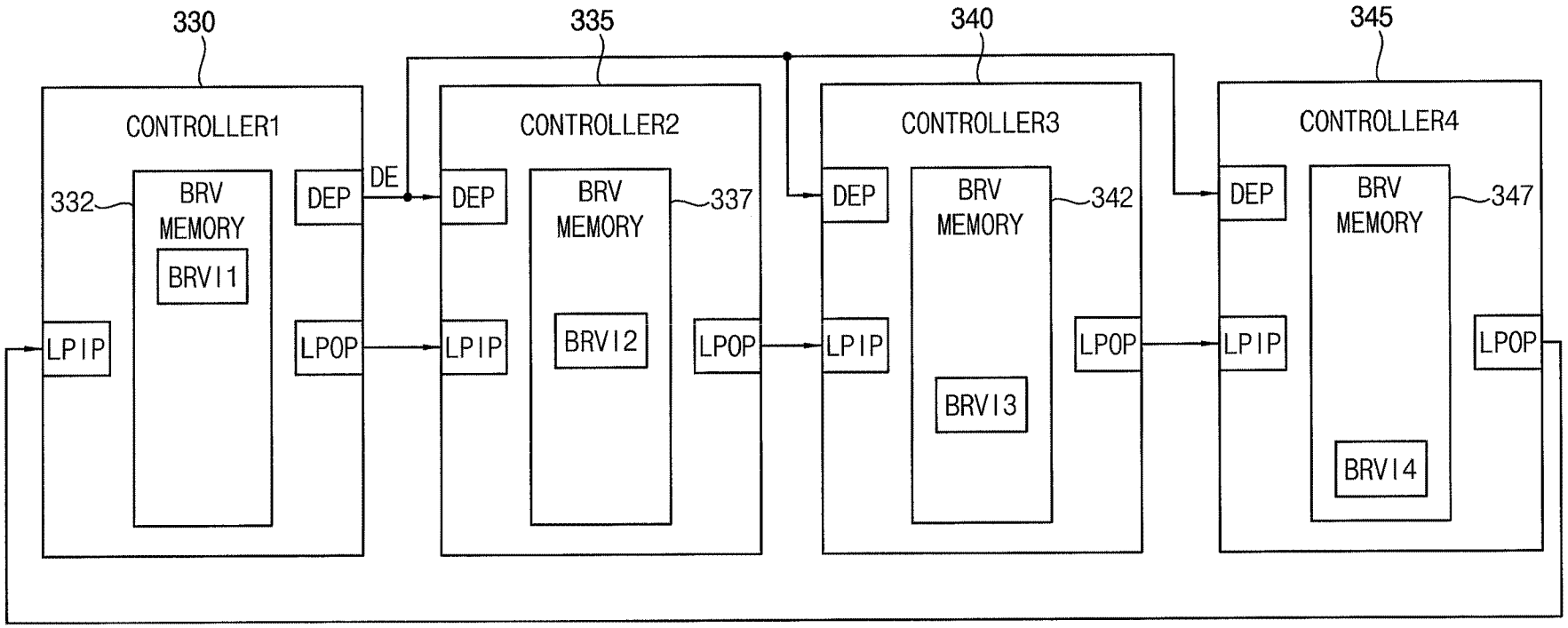
FIG. 10 is a block diagram for describing an example of a connection structure of first through fourth controllers included in a display device of FIG. 9.
Figure 11:
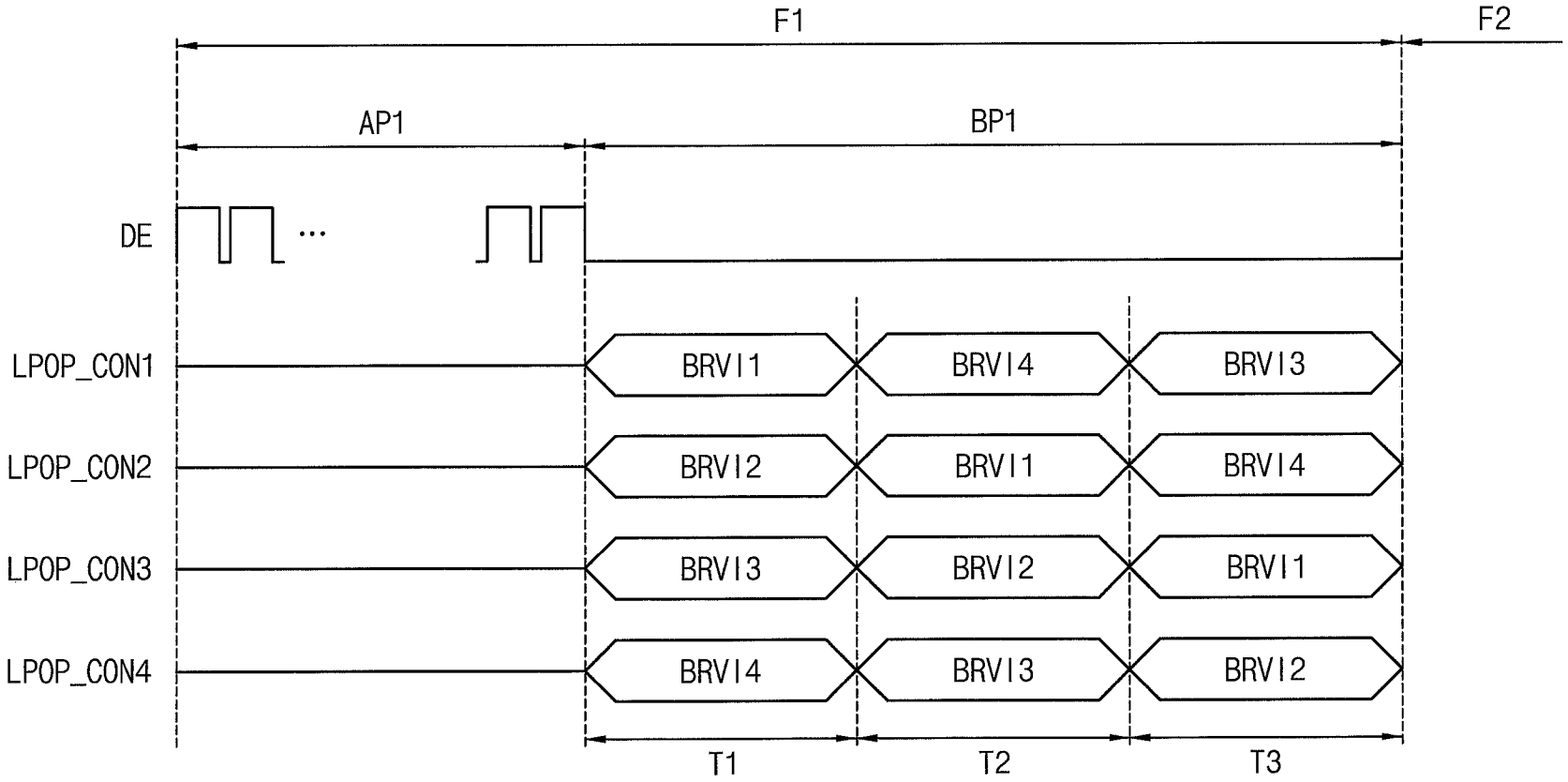
FIG. 11 is a timing diagram for describing an example where block representative value information is transferred among first through fourth controllers included in a display device illustrated in FIG. 9.

FIG. 9 is a block diagram illustrating a display device according to some example embodiments, FIG. 10 is a block diagram for describing an example of a connection structure of first through fourth controllers included in a display device of FIG. 9, FIG. 11 is a timing diagram for describing an example where block representative value information is transferred among first through fourth controllers included in a display device illustrated in FIG. 9, and FIGS. 12A through 12C are block diagrams for describing an example where block representative value information is transferred among first through fourth controllers included in a display device illustrated in FIG. 9.

Referring to FIG. 9, a display device 300 may include a backlight unit 310, a display panel 320, first through fourth controllers 330, 335, 340 and 345, first through fourth data drivers 350, 355, 360 and 365 respectively controlled by the first through fourth controllers 330, 335, 340 and 345, a gate driver 370, and first through fourth backlight drivers 380, 385, 390 and 395 respectively controlled by the first through fourth controllers 330, 335, 340 and 345.

The first controller 330 may receive first image data IDAT1 for a first portion 321 of the display panel 320, may generate first block representative value information BRVI1 for first pixel blocks located at the first portion 321 of the display panel 320, and may store the first block representative value information BRVI1 in a block representative memory 332.

The second controller 335 may receive second image data IDAT2 for a second portion 322 of the display panel 320, may generate second block representative value information BRVI2 for second pixel blocks located at the second portion 322 of the display panel 320, and may store the second block representative value information BRVI2 in a block representative memory 337.

The third controller 340 may receive third image data IDAT3 for a third portion 323 of the display panel 320, may generate third block representative value information BRVI3 for third pixel blocks located at the third portion 323 of the display panel 320, and may store the third block representative value information BRVI3 in a block representative memory 342.

The fourth controller 345 may receive fourth image data IDAT4 for a fourth portion 324 of the display panel 320, may generate fourth block representative value information BRVI4 for fourth pixel blocks located at the fourth portion 324 of the display panel 320, and may store the fourth block representative value information BRVI4 in a block representative memory 347.

Each of the first through fourth controllers 330, 335, 340, and 345 may include a light profile output pin at which the block representative value information BRVI1, BRVI2, BRVI3, and BRVI4 is output, and a light profile input pin at which the block representative value information BRVI1, BRVI2, BRVI3, and BRVI4 is received from another controller. Further, first through fourth controllers 330, 335, 340, and 345 may be connected in a ring structure such that the light profile output pin of the each of the first through fourth controllers 330, 335, 340, and 345 may be connected to the light profile input pin of the another controller.

In some example embodiments, as illustrated in FIG. 10, each of the first through fourth controllers 330, 335, 340, and 345 may include a data enable pin DEP, a light profile output pin LPOP and a light profile input pin LPIP. A data enable signal DE may be transferred from the data enable pin DEP of the first controller 330 operating as a master controller to the data enable pins DEP of the second through fourth controllers 335, 340 and 345 operating as slave controllers such that the first through fourth controllers 330, 335, 340 and 345 operate in synchronization with each other. Further, the light profile output pin LPOP of the first controller 330 may be connected to the light profile input pin LPIP of the second controller 335, the light profile output pin LPOP of the second controller 335 may be connected to the light profile input pin LP IP of the third controller 340, the light profile output pin LPOP of the third controller 340 may be connected to the light profile input pin LPIP of the fourth controller 345, and the light profile output pin LPOP of the fourth controller 345 may be connected to the light profile input pin LPIP of the first controller 330.

Among the first through fourth controllers 330, 335, 340, and 345 that are connected in the ring structure as described above, the first through fourth block representative value information BRVI1, BRVI2, BRVI3, and BRVI4 may be transferred at substantially the same time and/or during a vertical blank period.

Figure 12A:
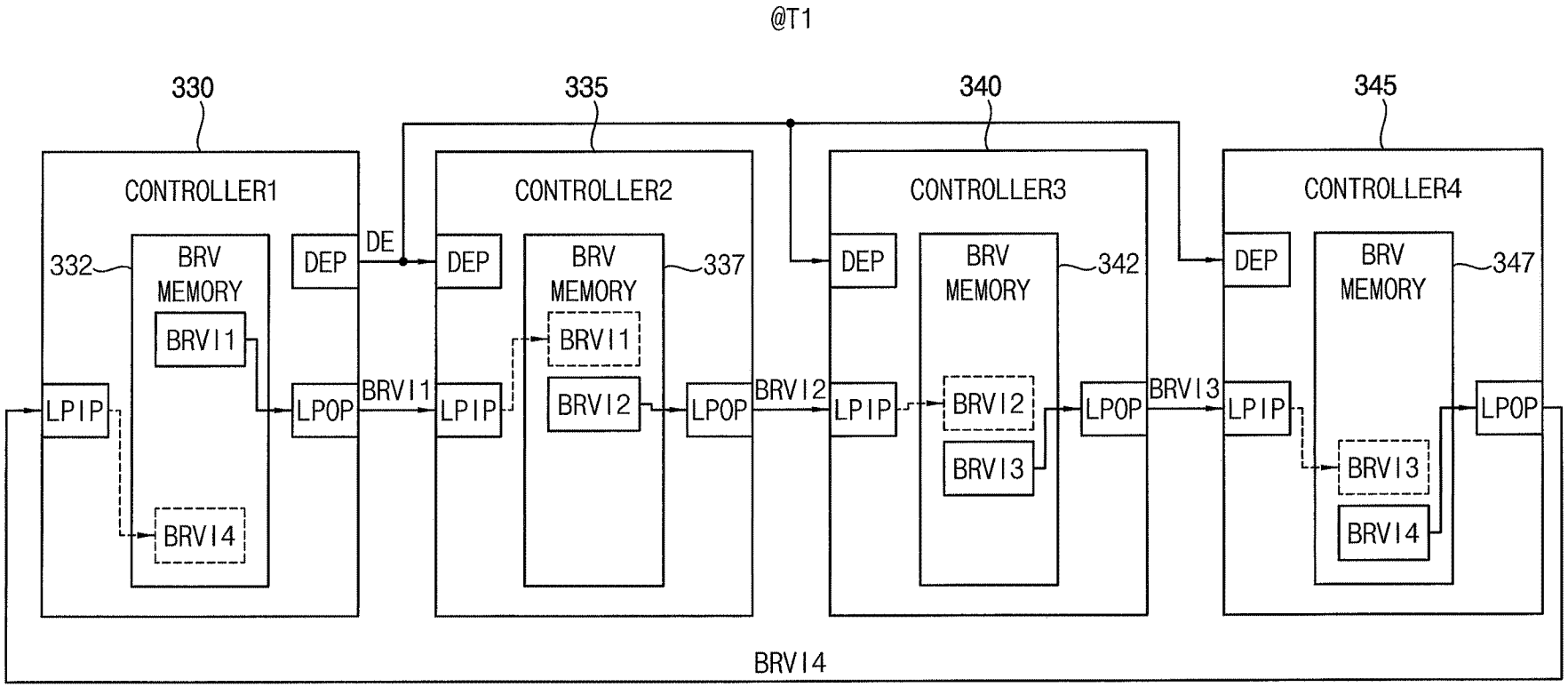
FIGS. 12A through 12C are block diagrams for describing an example where block representative value information is transferred among first through fourth controllers included in a display device illustrated in FIG. 9.

For example, referring to FIGS. 11 and 12A, during a first portion (or time period) T1 of a vertical blank period BP1, the first block representative value information BRVI1 may be transferred from the light profile output pin LPOP_CON1 of the first controller 330 to the second controller 335, the second block representative value information BRVI2 may be transferred from the light profile output pin LPOP_CON2 of the second controller 335 to the third controller 340, the third block representative value information BRVI3 may be transferred from the light profile output pin LPOP_CON3 of the third controller 340 to the fourth controller 345, and the fourth block representative value information BRVI4 may be transferred from the light profile output pin LPOP_CON4 of the fourth controller 345 to the first controller 330.

Figure 12B:
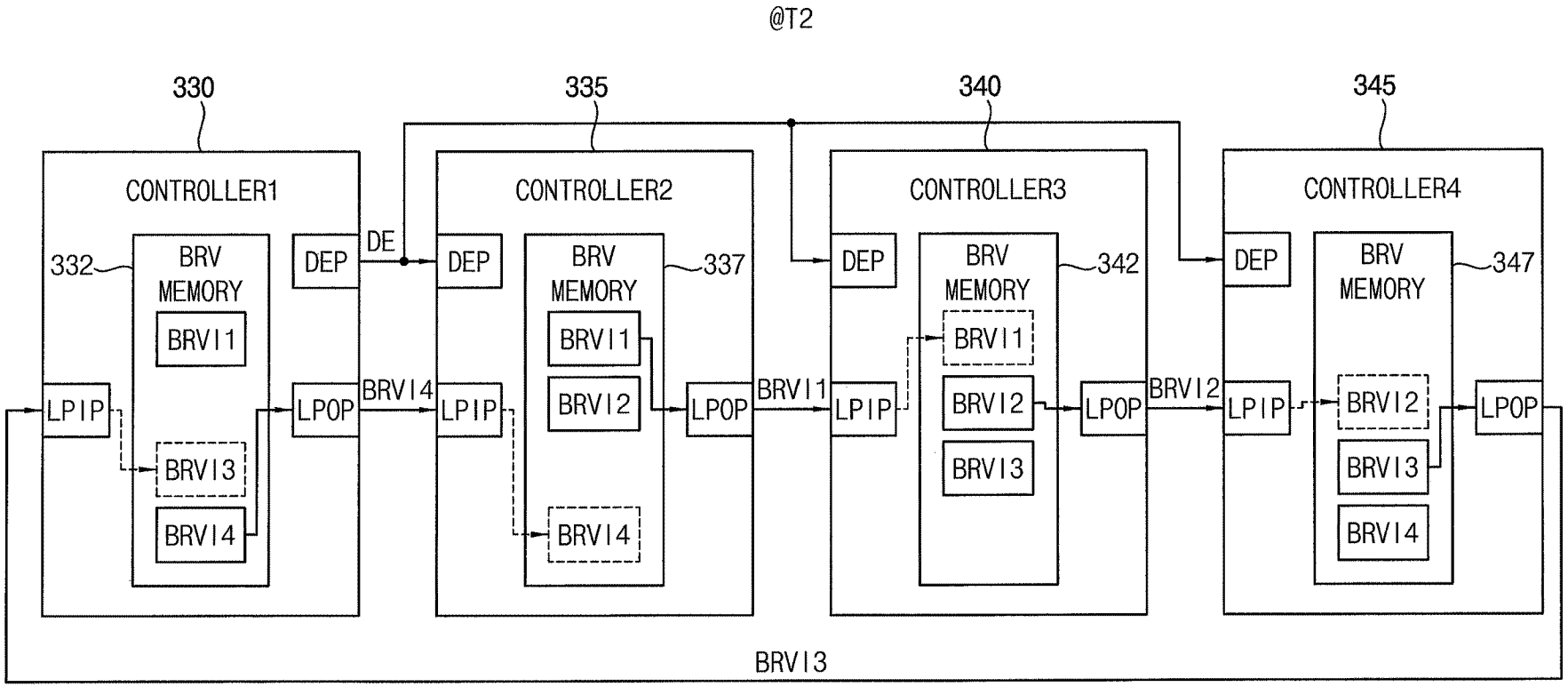

Further, referring to FIGS. 11 and 12B, during a second portion (or time period) T2 of the vertical blank period BP1, the fourth block representative value information BRVI4 may be transferred from the light profile output pin LPOP_CON1 of the first controller 330 to the second controller 335, the first block representative value information BRVI1 may be transferred from the light profile output pin LPOP_CON2 of the second controller 335 to the third controller 340, the second block representative value information BRVI2 may be transferred from the light profile output pin LPOP_CON3 of the third controller 340 to the fourth controller 345, and the third block representative value information BRVI3 may be transferred from the light profile output pin LPOP_CON4 of the fourth controller 345 to the first controller 330.

Figure 12C:
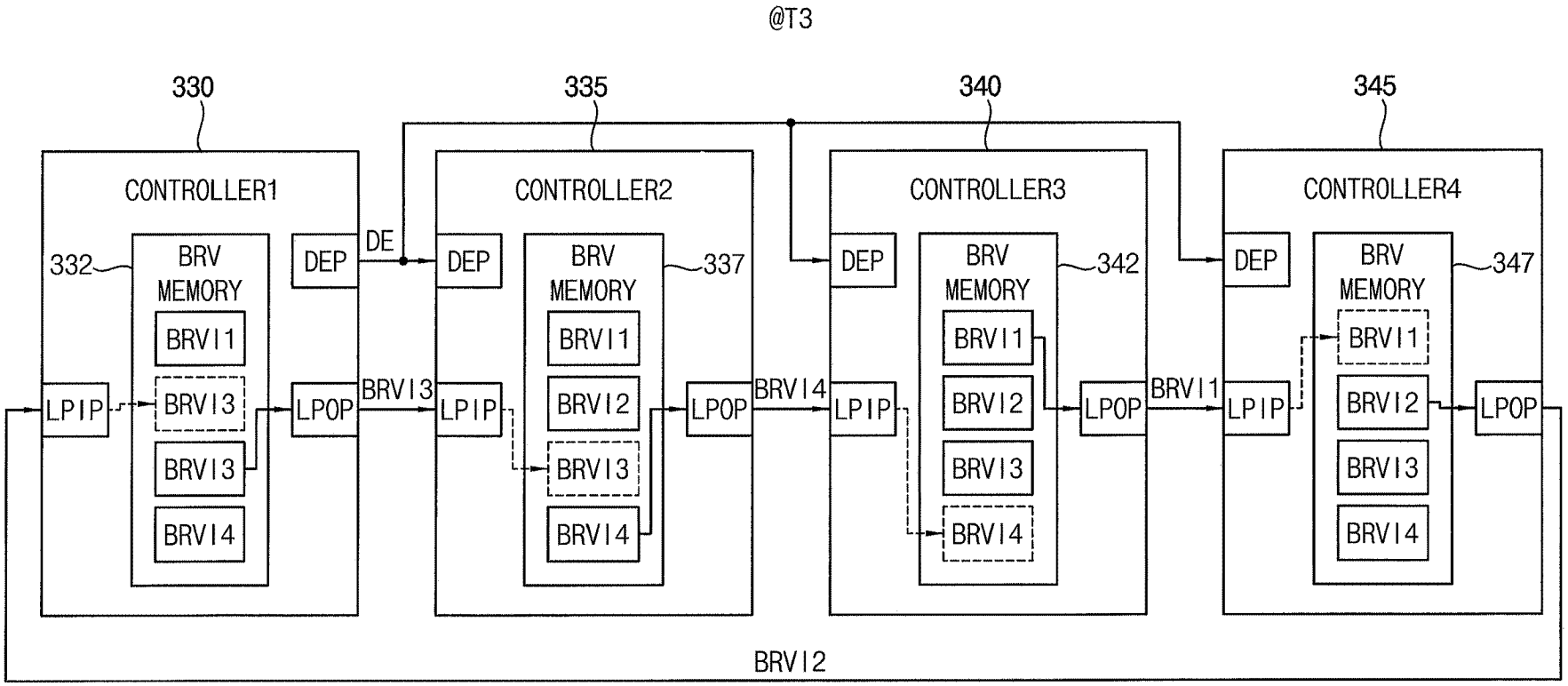

Further, referring to FIGS. 11 and 12C, during a third portion (or time period) T3 of the vertical blank period BP1, the third block representative value information BRVI3 may be transferred from the light profile output pin LPOP_CON1 of the first controller 330 to the second controller 335, the fourth block representative value information BRVI4 may be transferred from the light profile output pin LPOP_CON2 of the second controller 335 to the third controller 340, the first block representative value information BRVI1 may be transferred from the light profile output pin LPOP_CON3 of the third controller 340 to the fourth controller 345, and the second block representative value information BRVI2 may be transferred from the light profile output pin LPOP_CON4 of the fourth controller 345 to the first controller 330.

Accordingly, each of the first through fourth controllers 330, 335, 340, and 345 may store all of the first through fourth block representative value information BRVI1, BRVI2, BRVI3, and BRVI4, may generate substantially the same light profile information LPI based on all of the first through fourth block representative value information BRVI1, BRVI2, BRVI3, and BRVI4, and may compensate the image data IDAT1, IDAT2, IDAT3, and IDAT4 based on substantially the same light profile information LPI. The first through fourth data drivers 350, 355, 360, and 365 may provide the display panel 320 with data voltages corresponding to the image data ODAT1, ODAT2, ODAT3, and ODAT4 compensated based on substantially the same light profile information LPI. Accordingly, a phenomenon that boundaries among the first through fourth portions 321, 322, 323, and 324 of the display panel 320 are perceived because of compensation deviations among the first through fourth controllers 330, 335, 340, and 345 may be prevented.

Figure 13:
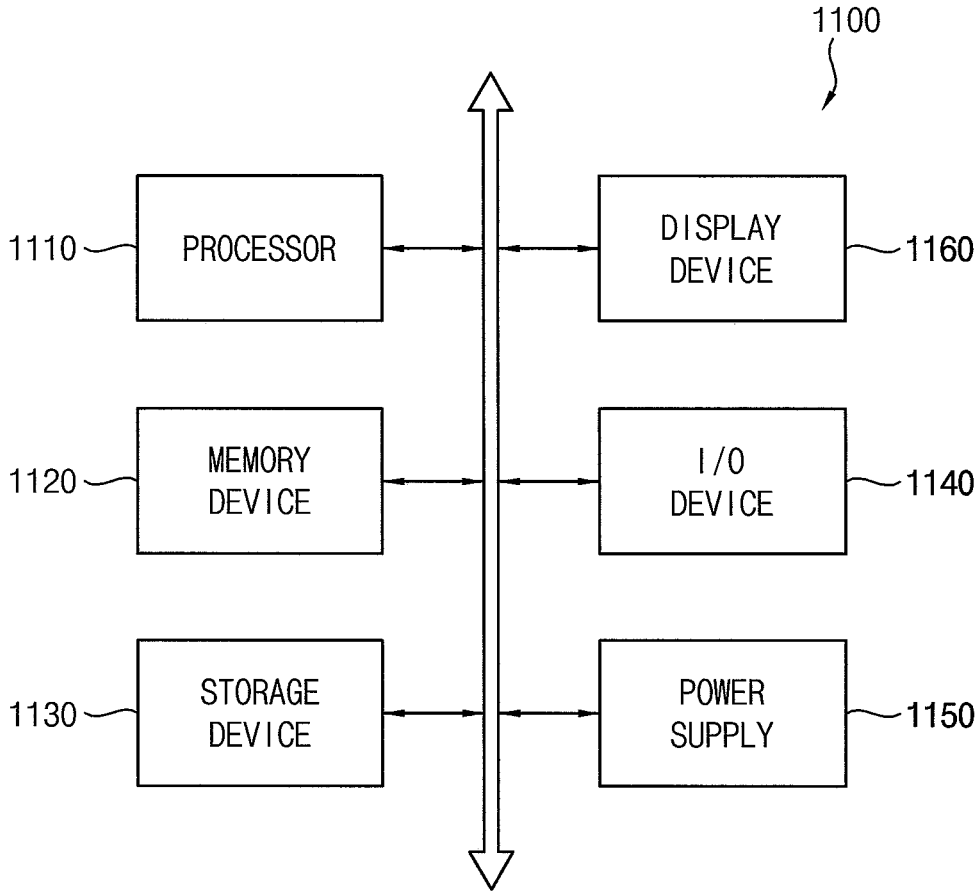
FIG. 13 is a block diagram illustrating an electronic device including a display device according to some example embodiments.

FIG. 13 is a block diagram illustrating an electronic device including a display device according to some example embodiments.

Referring to FIG. 13, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

In the display device 1160, block representative value information generated by a plurality of controllers may be transferred among the plurality of controllers. Each of the plurality of controllers may generate light profile information based on the block representative value information for all pixel blocks, and may compensate image data based on the light profile information. Accordingly, since the respective controllers may compensate the image data based on substantially the same light profile information, a boundary between the pixel blocks driven by different controllers may not be perceived.

The inventive concepts may be applied to any suitable display device 1160, and any suitable electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of aspects of some example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a backlight unit including a plurality of light emitting blocks;

a display panel including a plurality of pixel blocks respectively corresponding to the plurality of light emitting blocks;

a first controller configured to:

receive first image data for a first portion of the display panel; and generate first block representative value information for first pixel blocks located at the first portion of the display panel among the plurality of pixel blocks based on the first image data; and a second controller configured to:

receive second image data for a second portion of the display panel; and generate second block representative value information for second pixel blocks located at the second portion of the display panel among the plurality of pixel blocks based on the second image data, wherein the first controller is configured to receive the second block representative value information from the second controller, and the second controller is configured to receive the first block representative value information from the first controller, wherein each of the first and second controllers is configured to generate duty information for the plurality of light emitting blocks based on the first block representative value information and the second block representative value information, and to generate light profile information of the backlight unit based on the duty information, and wherein the first controller is configured to compensate the first image data based on the light profile information, and the second controller is configured to compensate the second image data based on the light profile information, wherein the first block representative value information and the second block representative value information are transferred between the first controller and the second controller in a vertical blank period.

2. The display device of claim 1, wherein the first block representative value information transferred from the first controller to the second controller includes representative gray values of the first pixel blocks, and the second block representative value information transferred from the second controller to the first controller includes representative gray values of the second pixel blocks.

3. The display device of claim 2, wherein representative gray values of each pixel block are determined based on a maximum gray value and an average gray value of a plurality of pixels included in the each pixel block.

4. The display device of claim 1, wherein the first block representative value information transferred from the first controller to the second controller includes a maximum gray value and an average gray value of each of the first pixel blocks, and the second block representative value information transferred from the second controller to the first controller includes a maximum gray value and an average gray value of each of the second pixel blocks.

5. The display device of claim 1, wherein the first block representative value information and the second block representative value information are simultaneously transferred between the first controller and the second controller.

6. The display device of claim 1, wherein the first block representative value information is transferred from a light profile output pin of the first controller to a light profile input pin of the second controller, and wherein the second block representative value information is transferred from a light profile output pin of the second controller to a light profile input pin of the first controller.

7. The display device of claim 1, wherein the first block representative value information and the second block representative value information are transferred between a data exchange pin of the first controller and a data exchange pin of the second controller.

8. The display device of claim 1, wherein the first controller comprises:

a block representative value memory;

a block representative value calculator configured to:

generate the first block representative value information for the first pixel blocks based on the first image data; and write the first block representative value information to the block representative value memory;

an interface configured to:

transfer the first block representative value information to the second controller by reading the first block representative value information from the block representative value memory; and receive the second block representative value information from the second controller to write the second block representative value information to the block representative value memory;

a duty calculator configured to generate the duty information for the plurality of light emitting blocks based on the first block representative value information and the second block representative value information;

a light profile calculator configured to generate the light profile information of the backlight unit based on the duty information; and a data compensator configured to compensate the first image data based on the light profile information.

9. The display device of claim 8, wherein the block representative value memory comprises:

a first memory unit to which the first block representative value information is written; and a second memory unit to which the second block representative value information is written, and wherein the first memory unit and the second memory unit are independently accessed.

10. The display device of claim 8, wherein the duty calculator is configured to generate the duty information by performing spatial filtering and temporal filtering on representative gray values of the plurality of pixel blocks represented by the first block representative value information and the second block representative value information.

11. The display device of claim 8, wherein the light profile calculator is configured to generate, as the light profile information, a light intensity value by the plurality of light emitting blocks at one or more reference positions with respect to each of the plurality of pixel blocks based on the duty information.

12. The display device of claim 11, wherein the data compensator is configured to calculate, with respect to each pixel located at the first portion of the display panel, a light intensity value of the each pixel by performing a bilinear interpolation on the light intensity values at the reference positions adjacent to the each pixel, and to adjust the first image data for the each pixel based on the light intensity value of the each pixel.

13. The display device of claim 1, wherein the second controller comprises:

a block representative value memory;

a block representative value calculator configured to:

generate the second block representative value information for the second pixel blocks based on the second image data; and write the second block representative value information to the block representative value memory;

an interface configured to:

transfer the second block representative value information to the first controller by reading the second block representative value information from the block representative value memory; and receive the first block representative value information from the first controller to write the first block representative value information to the block representative value memory;

a duty calculator configured to generate the duty information for the plurality of light emitting blocks based on the first block representative value information and the second block representative value information;

a light profile calculator configured to generate the light profile information of the backlight unit based on the duty information; and a data compensator configured to compensate the second image data based on the light profile information.

14. The display device of claim 1, further comprising:

a first data driver configured to receive the compensated first image data from the first controller, and to provide data voltages to the first portion of the display panel based on the compensated first image data; and a second data driver configured to receive the compensated second image data from the second controller, and to provide data voltages to the second portion of the display panel based on the compensated second image data.

15. The display device of claim 1, further comprising:

a first backlight driver configured to receive the duty information for first light emitting blocks corresponding to the first pixel blocks among the plurality of light emitting blocks from the first controller, and to drive the first light emitting blocks with duty values represented by the duty information for the first light emitting blocks; and a second backlight driver configured to receive the duty information for second light emitting blocks corresponding to the second pixel blocks among the plurality of light emitting blocks from the second controller, and to drive the second light emitting blocks with duty values represented by the duty information for the second light emitting blocks.

16. The display device of claim 1, further comprising:

a third controller configured to receive third image data for a third portion of the display panel, and to generate third block representative value information for third pixel blocks located at the third portion of the display panel among the plurality of pixel blocks based on the third image data; and a fourth controller configured to receive fourth image data for a fourth portion of the display panel, and to generate fourth block representative value information for fourth pixel blocks located at the fourth portion of the display panel among the plurality of pixel blocks based on the fourth image data, wherein the first through fourth controllers are connected in a ring structure with respect to the first through fourth block representative value information.

17. The display device of claim 16, wherein a light profile output pin of the first controller is connected to a light profile input pin of the second controller, wherein a light profile output pin of the second controller is connected to a light profile input pin of the third controller, wherein a light profile output pin of the third controller is connected to a light profile input pin of the fourth controller, and wherein a light profile output pin of the fourth controller is connected to a light profile input pin of the first controller.

18. The display device of claim 16, wherein, during a first portion of a vertical blank period, the first block representative value information is transferred from the first controller to the second controller, the second block representative value information is transferred from the second controller to the third controller, the third block representative value information is transferred from the third controller to the fourth controller, and the fourth block representative value information is transferred from the fourth controller to the first controller, wherein, during a second portion of a vertical blank period, the fourth block representative value information is transferred from the first controller to the second controller, the first block representative value information is transferred from the second controller to the third controller, the second block representative value information is transferred from the third controller to the fourth controller, and the third block representative value information is transferred from the fourth controller to the first controller, and wherein, during a third portion of a vertical blank period, the third block representative value information is transferred from the first controller to the second controller, the fourth block representative value information is transferred from the second controller to the third controller, the first block representative value information is transferred from the third controller to the fourth controller, and the second block representative value information is transferred from the fourth controller to the first controller.

19. A display device comprising:

a backlight unit including a plurality of light emitting blocks;

a display panel including a plurality of pixel blocks respectively corresponding to the plurality of light emitting blocks; and a plurality of controllers, each of the plurality of controllers being configured to:

receive image data for a corresponding portion of the display panel; and generate block representative value information for a portion of the plurality of pixel blocks located at the corresponding portion of the display panel based on the image data, wherein each of the plurality of controllers includes a light profile output pin at which the block representative value information is output, and a light profile input pin at which the block representative value information is received from another controller among the plurality of controllers, and wherein the plurality of controllers are connected in a ring structure such that the light profile output pin of the each of the plurality of controllers is connected to the light profile input pin of the another controller.

* * * * *